United States Patent [19]

Conway

[11] 4,375,181

[45] Mar. 1, 1983

[54] HYDRAULIC CYLINDER EXTENDING IN THREE FORCE MODES

[76] Inventor: John P. Conway, 172 Carriage La., Columbia, S.C. 29210

[21] Appl. No.: 226,550

[22] Filed: Jan. 21, 1981

[51] Int. Cl.[3] ..... F15B 15/17; F15B 13/042

[52] U.S. Cl. ..... 91/416; 91/422; 91/436

[58] Field of Search ..... 91/416, 422, 436; 137/517

[56] References Cited

U.S. PATENT DOCUMENTS

| | | | |
|---|---|---|---|
| 2,283,124 | 5/1942 | Peterson | 91/422 X |
| 2,800,110 | 7/1957 | Haarmeyer | 91/436 X |
| 2,875,732 | 3/1959 | Hoffman | 91/422 |
| 3,071,926 | 1/1963 | Olson | 91/436 X |
| 3,990,420 | 11/1976 | Bitterman | 137/517 X |
| 4,258,609 | 3/1981 | Conway | 91/422 X |

*Primary Examiner*—Robert G. Nilson
*Attorney, Agent, or Firm*—Benjamin G. Weil

[57] ABSTRACT

A multiple mode hydraulic piston assembly employing a regenerative hydraulic circuit which when incorporated in the piston of a hydraulic cylinder and assembled with a pressureized hydraulic source through appropriate piping and valving, will sequentially permit, restrict, and block liquid flow through the piston and will thus extend its piston rod in multiple force modes, namely a low force rapid extension mode, a moderate force rapid extension mode, and a high force extension mode. In response to fluid pressures within the cylinder chamber the multiple mode piston assembly automatically changes operational modes. First bi-directional flow is provided between opposing chambers, then uni-directional flow is provided from the rod end to the back end chamber, and finally flow between the chambers is blocked. A modified embodiment provides a free motion mode wherein a modest external force can displace the piston in either direction. An additional embodiment provides an arrangement of the elements offset from the geometrical axis of the piston. An embodiment of the foregoing construction provides a double-ended piston rod configuration.

18 Claims, 13 Drawing Figures

HYDRAULIC CYLINDER EXTENDING IN THREE FORCE MODES

BACKGROUND OF THE INVENTION

This invention relates to a hydraulic fluid power linear actuator employing a cylinder and combined piston and piston-rod assembly of elements to convert a supply of pressurized hydraulic fluid to linear mechanical force or motion.

Hydraulic fluid powered cylinders are used in a multiplicity of applications in many diverse fields such as aerospace, marine, military, industrial, automotive, and manufacturing. Most hydraulic fluid powered cylinders employed in these fields consist of devices where the extension rate of a given cylinder system is not a function of the load force requirements, but a function of the rate at which fluid is supplied to the cylinder. The available force at which a cylinder extends is usually a function of the characteristics of the load a cylinder must move; i.e., for a given cylinder bore, the greater the load, the higher the force at which the cylinder must operate. If it is desired to maintain a lower pressure, a larger bore cylinder would be required to move the same load.

Manufacturing operations such as clamping, pressing, die stamping and compacting of materials for bailing may be accomplished by such cylinders. Some of these types of operations would be improved greatly if, in the interest of saving time, the cylinder would extend at a rate that was inversely proportional to the load applied thereto. In other words, improved results would be provided if the actuator could supply power to the load at a more uniform rate. Since power is the product of rate of travel times force, this means providing a relatively fast extension rate when the load is light and a relatively slow extension rate when the load is heavier.

A conventional hydraulic fluid power cylinder has two inherent performance characteristics: (1) an increase in the rate of supply of hydraulic fluid to the expanding chamber of the cylinder is required for a proportional increase in the rate of motion of the piston rod and (2) an increase in the pressure differential across the piston is required for a proportional increase in the force that the piston can apply to a load.

Most liquid power linear actuators consist of devices where the extension rate of the piston and piston-rod combination is proportional to the rate at which the pressurized liquid is supplied. Thus, if pressurized liquid is supplied at a constant rate, such an actuator would extend at the same rate throughout its travel regardless of the load. Accordingly, these systems must be designed to meet maximum load conditions regardless of the relatively short intervals of time during which maximum load is applied to the piston rod. This can, and does, result in the poor and inefficient utilization of the pressurized liquid when the load is low and in an expensive waste of equipment, time, liquid and energy.

There are numerous applications wherein it would be desirable to have a cylinder that would travel at various speeds and exert varying forces upon varying loads. In the operation of a conventional cylinder at the beginning of a stroke, the cylinder will have to overcome a relatively small load (in most cases no more than internal friction) and can thus travel quite rapidly with the available power from the fluid source. During this portion of the cycle, the cylinder operates at low system pressure. However, the rate of speed at which the piston travels is controlled, not by pressure, but by fluid delivery rate. When the piston rod encounters a greater resistance (a larger load), in order to continue traveling at the same rate of speed, delivery rate remains constant while pressure increases. If a still greater load is encountered, but a relatively high speed is not required, as in the terminal portion of the stroke, delivery rate can be reduced and fluid delivery pressure increased.

To meet and overcome these and many other varying load conditions, various complex means have been devised and arranged to solve this problem.

Some of these complex systems utilize complex supply systems which provide more pressurized fluid when the load is low, resulting in a faster piston rod extension rate and then less liquid at a higher available pressure when the load is higher, resulting in a slower extension rate. Examples of such systems include variable displacement pumps, dual pressure liquid supply systems and systems which store hydraulic fluid under pressure, such as with accumulators.

Other liquid power linear actuators extend at a faster or slower speed, depending on load, while being supplied with pressurized liquid at a constant rate. A number of such systems involve complex combinations employing a plurality of piston and piston-rod cylinder assemblies. Others utilize a regenerative cylinder circuit which supplies additional pressurized liquid to the expanding back end chamber of the cylinder by feeding the pressurized liquid to the back end chamber from the rod end chamber.

Most of these regenerative cylinder circuits locate the necessary valving and liquid conduits outside of the cylinder, which usually results in a difficult and awkward arrangement because of design problems involving short liquid connections and because of the requirements for both high pressure and high flow conditions.

A few regenerative cylinder circuits locate the valving and liquid passages within the piston inside the cylinder. Generally, these circuits have found limited acceptance because of the manner in which four fundamental requirements are handled: (1) the need for controls which detect when the piston valve should be open or closed in the course of the work cycle, (2) the means by which this information is communicated to and acts on the piston valve, (3) the need to save time during all nonproductive time periods during a complete work cycle, with special attention to the return of the piston to its retracted starting position, and (4) the complexity of the device.

My invention provides an improvement upon the invention described in my co-pending application, Ser. No. 841,217, filed Oct. 11, 1977. The prior application utilizes a regenerative cylinder circuit with valving and liquid passages located within the piston inside the chamber. However, that invention provides a piston valve of different configuration from that of the present invention in that the valve disc is fixed to a valve stem requiring the two elements to cooperate in unitary movement in contrast to the configuration of the present invention which discloses independently movable discrete unattached valve disc and plunger. While my previous invention is a meritorious invention and is useful in practice, it has certain shortcomings. In my prior invention, the rapid advance mode is terminated by physical constants, namely the elastic characteristics of the valve spring and the cross-section area of the valve stem. In contrast, the termination of the rapid extension mode of the present invention is not dependent on such characteristics and will function with a wide range of geometrical relationships of component elements. In the prior invention, for a given cylinder assembly, changing the predetermined load value, which determines the end of the rapid extension mode, can only be accomplished by disassembling and modifying the piston valve assembly. Further, setting a high predetermined load value is difficult because of the complications presented by the physical requirements that call for a bias spring with a higher strength or a valve stem with a smaller cross-sectional area. Also, utilizing a relatively low predetermined load value for a particular work cycle will result in poor operating efficiencies since the higher available force in the rapid extension mode cannot be utilized. Lastly, utilizing a relatively high predetermined load value for a particular work cycle will result in better efficiency, but a more precise control of the external valving will be required to insure that the liquid is not allowed to exit from the rod end chamber below the predetermined load value, thereby rendering the system inoperative.

As a result of this different and improved valve configuration, hereinafter described in detail, the cylinder of the present invention extends at two speeds, and in three force modes. The cylinder of my prior invention extends at two speeds, but in only two force modes. As a result of the provision of an additional force mode substantial savings in the operating cycle of my cylinder is achieved, with consequent reduced cycle time and increased efficiency of operation.

SUMMARY OF THE INVENTION

The present invention consists of a piston valve comprising a valve seat, a movable valve member acted on by a pressure responsive plunger and liquid passages which are incorporated in the piston of a cylinder piston-piston rod device to produce a liquid powered linear actuator when assembled with a source of pressurized liquid and conventional fluid valving external to the cylinder. My piston valve permits, restricts, and blocks liquid flow through the piston between the opposing cylinder chambers thus permitting my linear actuator to perform the following complete and useful work cycles: (1) the piston extends with relative speed against a relatively light load, in an operational mode called the low force rapid extension mode, with liquid passing through the piston valve which is open, from the rod end cylinder chamber to the back end cylinder chamber in a regenerative cylinder circuit, (2) when the magnitude of the load increases above the predetermined load value, my piston valve automatically changes to the seated position where only unidirectional flow occurs from the rod end to the back end chamber, slightly separating the movable valve member from its seat while the piston continues to extend at the same rate against a somewhat increased load in an operational mode called the moderate force rapid extension mode, with the liquid still passing through my piston valve assembly from the rod end to the back end cylinder chamber in a regenerative cylinder circuit, (3) when an external control valve permits liquid to exit from the rod end cylinder chamber (unloading the pressurized fluid from the cylinder), the piston will continue extending against a load but at a slower rate with greater available force in the high force extension mode, with piston valve closed and no flow being permitted through the piston from the back end to the rod end cylinder chamber, in the manner of operation of a conventional solid piston hydraulic cylinder, and (4) when an external control valve connects the back end cylinder chamber to a reservoir at atmospheric pressure, my piston valve assembly automatically begins the free motion mode allowing a rapid return of the piston rod to its initial retracted position by a modest external force.

My valve assembly automatically changes from the open, bidirectional flow position to the seated, unidirectional flow position when the magnitude of the external load exceeds the predetermined load value. This occurs because the internal cylinder liquid pressure increases in proportion to the external load and acts on and displaces the pressure responsive valve plunger into its bore to allow independent movement of the movable valve member to a position against the valve seat, the valve member and the valve plunger being discrete and unattached elements capable of independent movement. Any time piston valve is in the seated position it will automatically change to the closed position when the pressure in the rod end chamber is unloaded to reservoir by an external valve. My valve assembly automatically opens when the internal cylinder pressure drops to a point where the pressure responsive valve plunger can move the movable valve member away from the valve seat. This drop in internal cylinder pressure is usually accomplished by connecting the back end cylinder chamber to a liquid reservoir at atmospheric pressure. The valve plunger is responsive to the internal cylinder pressure because it is slidably positioned in a close fitting bore with a dynamic seal and the force created by the liquid pressure acting on one end of the plunger is opposed by a bias force on the other end provided by a compression spring placed in a spring cavity. This cavity is either vented to atmosphere or its equivalent to provide a reference pressure. Any pressure related force in this cavity would be very small compared to the other forces acting on the plunger. The term bias, bias force, and bias spring force, as used in the application is meant to mean that force which must be overcome by the internal cylinder pressure before the movable valve member can go from the open position to the seated or closed position.

In one embodiment the spring cavity, which contains the compression spring supplying the bias force against one end of the valve plunger, is connected by a passage extending lengthwise down the piston rod to a port exiting the piston rod at a location which is always external to the cylinder housing. This embodiment is shown with two alternate control systems one with the port venting directly to atmosphere, and the other including an external flexible conduit and control valve which can either selectively connect said port to atmospheric pressure or to a source of pressurized fluid. This pressurized fluid can serve to lock the piston valve in the open position regardless of the external load force applied to the piston rod.

In another embodiment, the passage extending lengthwise down the piston rod connecting the spring cavity and the port external to the cylinder is eliminated and an alternate construction is provided by connecting the spring cavity to a cavity located within the piston-piston rod assembly which contains a compressible material or gas at a pressure close to atmospheric pressure, or at a pressure which is relatively small when compared to the liquid pressures utilized in the system, to provide a reference pressure.

In yet another embodiment the geometry of the piston valve structure is altered so that essentially all of the required machining operations are included in the piston and not the piston rod.

In still another embodiment the geometry of the piston valve structure is altered so that it can be utilized in a cylinder with a piston rod extending from both ends. It is required that the cross-sectional area of one piston rod be smaller than the other.

For the purpose of illustrating the improvements and advantages of the present invention over my prior invention, Ser. No. 841,217, filed Oct. 11, 1977, let us assume that (1) both cylinders are supplied pressurized liquid at the same constant rate, 1 cubic inch per second with the maximum pressure being 2000 psi; (2) both cylinders extend 12 inches against the same load and then clamp with 12,000 pounds, the load increasing at 200 pounds per inch of displacement; (3) both cylinders include a 50 pound bias force compression spring; (4) both cylinders are dimensionally similar; and (5) both systems are configured to perform the work task in the minimum possible time. The piston valve in each cylinder leaves the open position when each cylinder encounters a load of 200 pounds, which is proportionally accompanied by a 200 psi internal cylinder pressure. In my previous invention the piston valve goes to the closed position and the high force mode begins, while in the case of my current invention the piston valve goes to the seated position and the moderate force rapid extension mode begins.

In the case of my prior invention the cylinder will extend from 0 to 1 inch in one second in the (low force) rapid extension mode, and then continue for a further extension from one inch to twelve inches in 66 seconds in the high force extension mode.

In the case of the present invention, the cylinder extends from 0 to 1 inch in one second in the low force rapid extension mode, from one inch to 10 inches in nine seconds in the moderate force rapid extension mode and from 10 to 12 inches in 12 seconds in the high force extension mode.

Thus it can be seen that the cylinder of the prior invention requires 67 seconds to perform the work task, while the cylinder of the present invention requires only 22 seconds to perform the same work under the same conditions.

The time saving is the result of the moderate force rapid extension mode provided by the different and novel valve configuration found in the present invention.

It is therefore one object of the invention to provide a hydraulic cylinder that extends in three force modes.

It is another object of the invention to provide a hydraulic cylinder that effectively and efficiently utilizes regenerative circuitry.

It is yet another object of this invention to provide an improved hydraulic cylinder which operates more efficiently and therefore saves time and money.

It is still another object to provide such a device with a relatively simple modification of the piston and cylinder structure and without complex controls in the fluid supply system associated therewith which permits positioning the cylinder piston by an external force with a minimum of fluid resistance.

It is again another object to provide a spring-loaded slidable plunger to exert a force on the valve disc, the plunger being balanced by a spring and a reference pressure on one side and by the valve disc and pressure of the fluid within the cylinder on the other side.

It is a further object of the invention to provide a low force rapid extension mode, a moderate force rapid extension mode, and a high force extension mode.

It is still further object of the invention to provide an additional mode of operation, namely a free motion mode wherein a small force can displace the piston in either direction.

It is an additional object of the invention to provide a reference pressure for the slidable spring-loaded plunger comprising a sealed chamber containing a capsule containing at least one closed cell enclosing a gas at substantially atmospheric pressure.

It is one other object of the invention to provide a valve which, when incorporated in the piston of a hydraulic cylinder in a system which includes a pressurized liquid source and conventional directional control valving, makes it possible to employ a regenerative cylinder circuit and provide extension against a load at two rates.

It is again a further object of the invention to provide a piston valve which permits change of the cylinder from the moderate force rapid extension mode to the high force extension mode at any time in the work cycle above a predetermined load valve by an external control valve.

It is another object of the invention to provide a piston valve which eliminates the necessity for setting the predetermined load value at a high value, avoiding the complications presented by the physical requirements of a bias spring with a higher strength or a valve plunger with a smaller cross section or both of the foregoing.

It is again another object of the invention to provide a piston valve offering high operating efficiencies by using higher available forces in the rapid extension modes due to sole control of the end of this mode by an external valve.

It is a final object of the invention to provide a piston valve substantially eliminating the inoperative mode resulting from premature exiting of the liquid from the rod end, because the predetermined load value can be set at relatively low value.

BRIEF DESCRIPTION OF DRAWING FIGURES

DETAILED DESCRIPTION OF A PREFERRED EMBODIMENT

Figure 1:
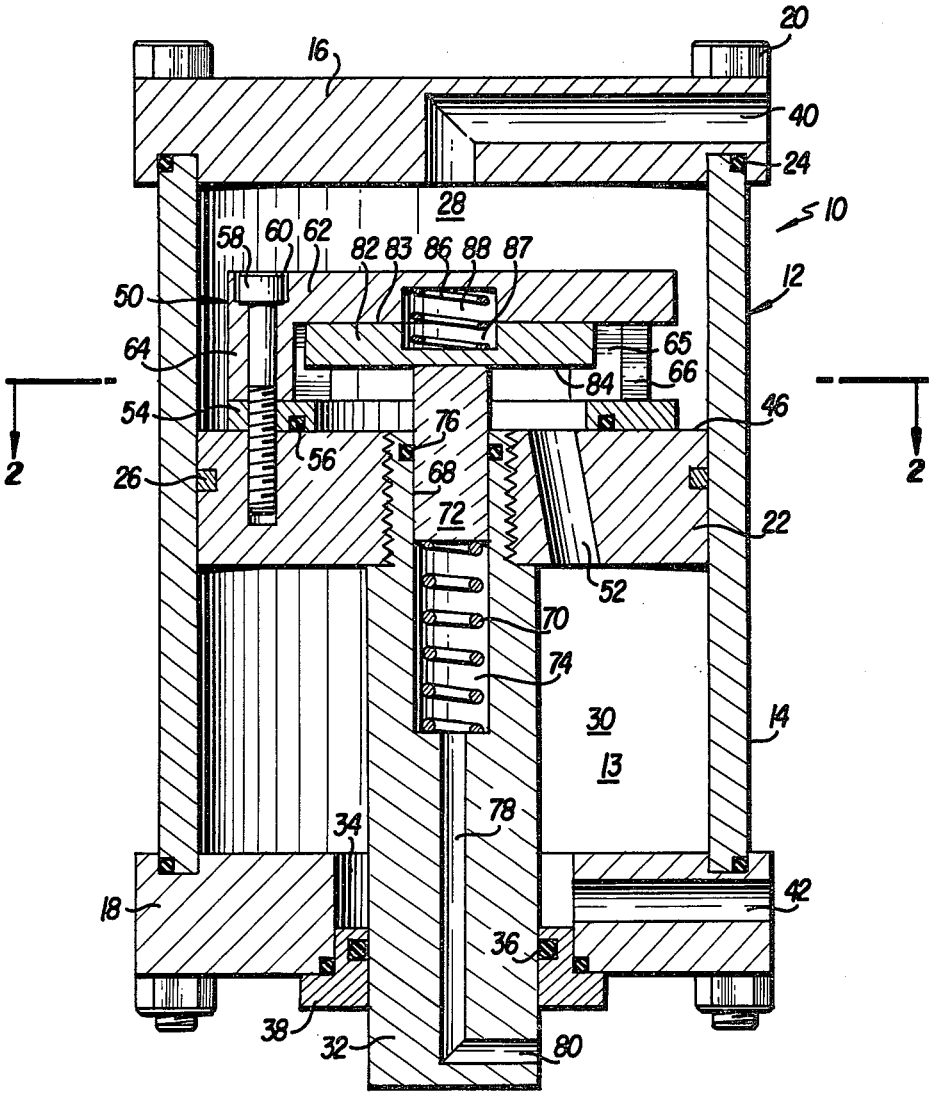
FIG. 1 is a longitudinal section view taken substantially through a hydraulic cylinder piston device constructed in accordance with the present invention.

Referring now to the drawings, FIG. 1 illustrates a hydraulic cylinder piston device generally referred to by reference numeral 10. The cylinder piston device includes a pressure sealed housing, generally referred to by reference numeral 12, which forms a cylindrical chamber containing in a sliding relationship, a piston 22 and its connected piston rod 32 with the piston dividing the chamber into two opposing pressure chambers 28 and 30. Housing 12 is composed of a cylindrical wall portion 14 connected at one axial end to back end block 16 and at the other axial end to rod end block 18. Long bolt assemblies 20 hold the end blocks and cylindrical wall portion 14 assembled to form a pressure sealed cylindrical chamber 13 within which piston 22 is slidably displaced between the end blocks 16 and 18. Static seals 24 prevent leakage of pressurized liquid from cylindrical chamber 13 while annular piston rings 26 on the piston 22 wipingly engage the inner cylindrical surface of the wall portion 14 in order to sealingly divide cylindrical chamber 13 into opposing pressure chambers 28 and 30. Chamber 28 which is partially bordered by piston face 46 and by back end block 16 will be called the back end chamber, while chamber 30 which is partially bordered by piston face 48 and by rod end block 18 will be called the rod end chamber. Piston rod 32 is threadedly connected to the piston 22 and extends therefrom through the rod end chamber 30 and projects from housing 12 through a central opening 34 in the rod end block 18. A slide bearing 38 is received within the opening 34 and provided with a dynamic seal 36 for wiping engagement with the piston rod 32. A passage 40 is formed in back end block 16 for supplying pressurized liquid to back end chamber 28 and alternately, to permit exhaust of liquid therefrom. Passage 42 is formed in the rod end block 18 communicating with the central opening 34 in order to accomplish outflow of liquid from rod end chamber 30.

In accordance with the present invention, a piston valve generally referred to by reference numeral 50, is incorporated into piston 22 and piston rod 32. Piston valve 50 includes passages and bores in the piston and piston rod as well as including additional components. A general discussion of the operation of piston valve 50 would appear appropriate at this point to fully understand its structure. When in the open position, the piston valve permits bidirectional liquid flow between chambers 28 and 30. Alternately, piston valve 50, when in the seated position, permits unidirectional liquid flow through said piston valve. In the seated position, essentially free liquid flow is permitted from rod end chamber 30 to back end chamber 28 but the liquid flow is blocked in the opposite direction. In the closed position of piston valve 50, liquid flow is blocked from back end chamber to rod end chamber and there is no liquid flow through piston valve 50 in either direction. In FIG. 1, piston valve 50 is shown in the open position.

Figure 2:
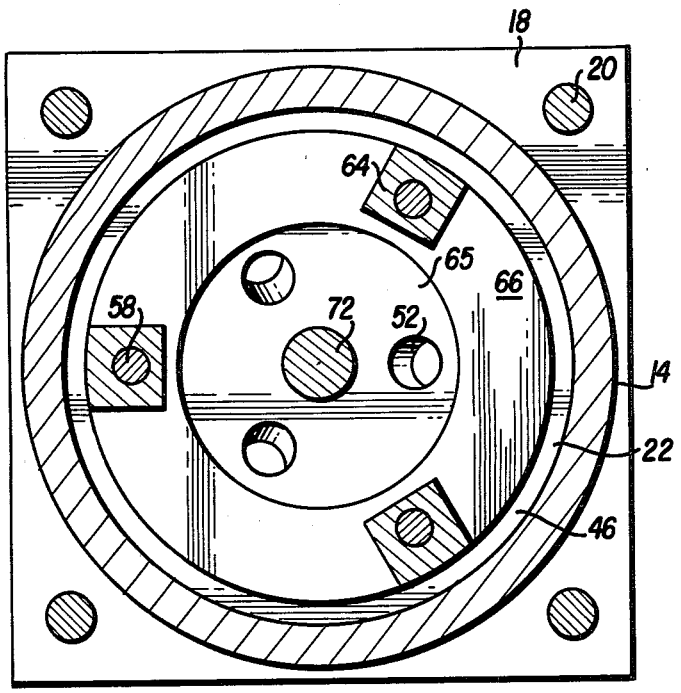
FIG. 2 is a transverse section view taken substantially through a plane indicated by section line 2—2 in FIG. 1.
Figure 3:
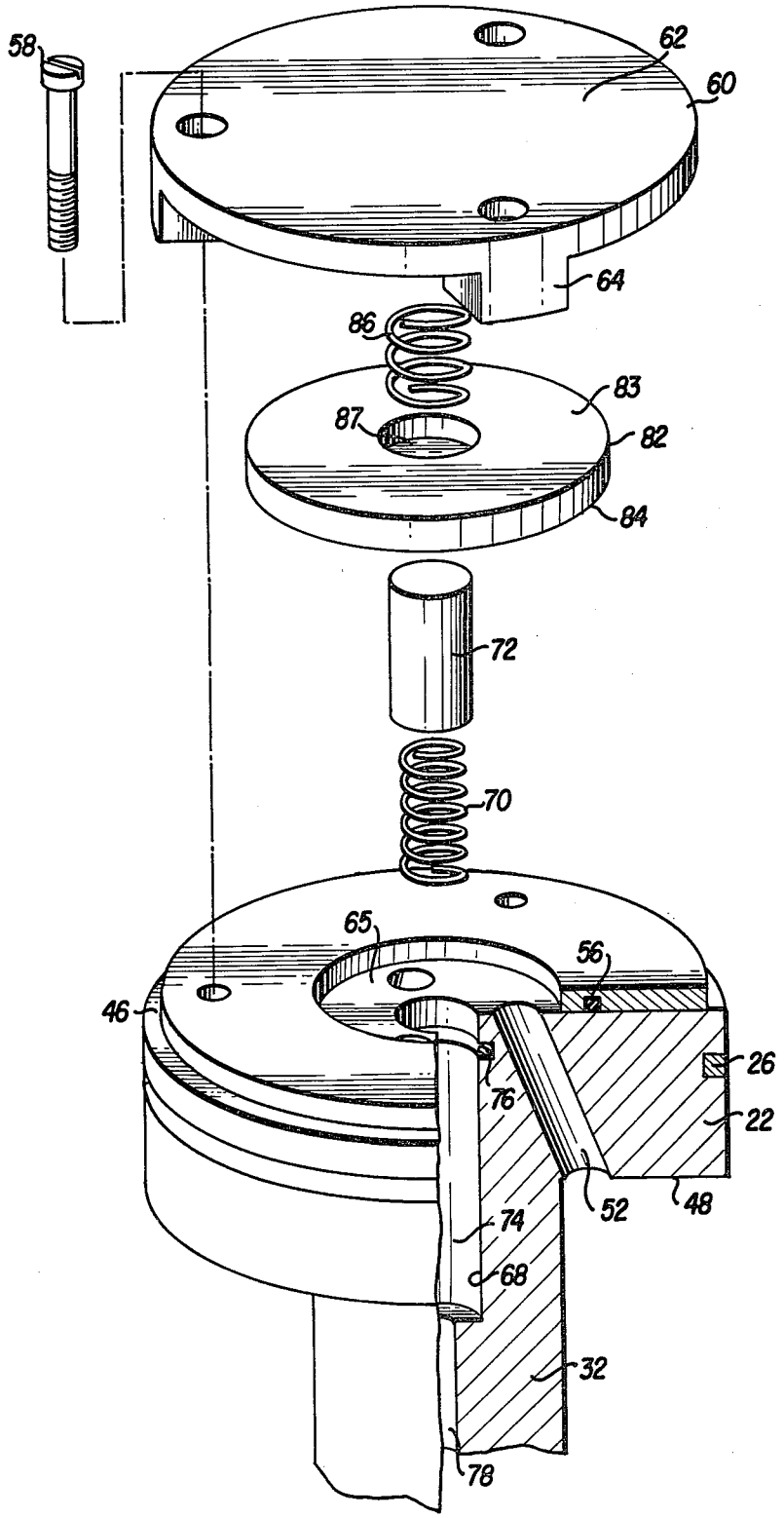
FIG. 3 is an explosive illustration of the piston valve as shown in FIG. 1.

In accordance with the present invention several flow passages 52 are formed in piston 22 and extend from one face 46 of piston 22, exposed to back end chamber 28, to the other face 48 of the piston exposed to rod end chamber 30. An annular shaped valve seat 54 is positioned on the piston face 46 in a sealing relationship because of the static annular seal 56. The valve seat element 54 is held assembled on the piston by means of a plurality of assembly bolts 58 that extend through retainer cap 60 through said valve seat 54 into threaded engagement with piston 22. The retainer cap 60 includes a stop disc portion 62 from which a plurality of spacing legs 64 extend into engagement with valve seat 54. The assembly bolts 58 extend through the stop disc portion 62 and the spacing legs 64. Cavity 65 is formed in the space generally defined within retainer cap 60, under stop disc portion 62, surrounded by spacing legs 64, and above surface 46 of piston 22. Passages 66 are accordingly formed between the spacing legs 64, as more clearly seen in FIG. 2 and FIG. 3, through which free liquid communication is established between cavity 65 and back end chamber 28. Free liquid communication is also established between cavity 65 and rod end chamber 30 by flow passages 52. Bore 68 extends from surface 46 of the piston-piston rod assembly into piston rod 32 and receives compression spring 70 and valve plunger 72 to form spring cavity 74. Valve plunger 72 is in a sliding relationship with bore 68 and dynamic seal 76 which is contained in an annular shaped groove around bore 68. Spring cavity 74 is vented to a reference pressure which may be and is the atmosphere in the embodiment illustrated in FIG. 1 by means of a vent passage 78 which extends longitudinally through piston rod 32 connecting spring cavity 74 to vent port 80 which exits to atmosphere at a point on the surface of said piston rod which is always ouside of cylinder housing 12 regardless of the position of said piston rod 32. The term "vent" as used herein means a passage to a reference pressure, usually a constant reference pressure such as the atmosphere. In the position shown compression spring 70 applies an upward force against movable valve plunger 72, which bears against circular valve disc 82 which, in turn, bears against the stop disc position 62 of retainer cap 60 valve disc 82 being unattached to valve plunger 72. Thus both disc 82 and plunger 72 are discrete elements independently movable from each other. Surface 83 is the horizontal area on the top axial side of valve disc 82 while surface 84 is the horizontal area on the bottom side thereof, these areas being equal. Light compression spring 86 is partially contained in a bore 87 extending from the top surface 83 of valve disc 82 into valve disc 82, and partially contained in a bore 88 extending from the bottom surface of retainer cap 60 and extending upwards into the stop disc portion 62 of retainer cap 60. Light compression spring 86 bears against the bottom of said bore in which it is contained and continually urges valve disc 82 with a light force, in a downward direction toward a position against valve seat 54. In FIG. 1 piston valve is shown in the open position since the fluid within cylinder housing 12 is at atmospheric pressure and the bias spring force supplied by compression spring 70 is many times stronger than the light disc spring 86. Bias spring force is defined as the force which must be overcome before the piston valve disc 82 can go from the open position to the seated position. The bias spring force is provided by compression spring 70 and is relatively constant in magnitude. The bias force of spring 70 must be exceeded by the pressure resultant force within the cylinder acting on cross-sectional area of valve plunger 72 before the piston valve disc can be positioned in the seated position. Valve disc 82 is loosely contained within retainer cap 60 in cavity 65, and it is apparent that if valve plunger 72 ceased bearing against said valve disc, the valve disc 82 would be urged toward or positioned lightly against valve seat 54 by light disc spring 86. Defining this light positioning of valve disc 82 against valve seat 54 as piston valve 50 being in the seated position, it is apparent that when this exists cavity 65 is divided and an open flow passage no longer exists between back end chamber 28 and rod end chamber 30, only unidirectional flow from rod end chamber 30 to back end chamber 28 being permitted while flow in the opposite direction from the back end chamber to the rod end chamber is blocked. In the seated position, the valve disc 82 is urged by light disc spring 86 to a position towards the valve seat 54 similar to the relationship that exists between the parts of a common check valve with flow passing through the valve. Light positioning does not mean that there is constant continuous sealing contact between valve disc 82 and valve seat 54. Under dynamic conditions encountered in the moderate force rapid extension mode, valve disc 82 will float slightly apart from valve seat 54 balanced between a fully seated contact with valve seat 54 and the open position, separated by the flow of liquid from the rod end to the back end of the cylinder. A representative value of the gap between valve disc 82 and valve seat 54 would be 0.015 inch. As long as the cylinder continues to extend in this mode, such flow will persist. However, if such extension should cease, disc 82 will seat firmly and fully, since such flow no longer takes place. While valve element 82 and its counterparts are termed "disc", this is intended to include equivalent configurations such as, for example, that of element 182' in FIG. 11-A.

It is preferred to employ light spring 86 to urge valve disc 82 towards valve seat 54, but equivalents may be substituted. Such equivalent may include use of a valve disc of sufficient mass that the effect of gravity will provide the desired urging force. Such a configuration would find primary utility if the cylinder were in a substantially downwards extending position. Likewise, magnetic means, the arrangement of which would be obvious to one skilled in the art, may be employed for such purposes. However, some form of means equivalent to light spring means 86 must be employed to relieve dependency on system dynamics and thereby provide positive action means for eliminating the effects of extraneous factors such as viscosity, flow rate and bouyancy of the valve disc 82.

OPERATION OF A PREFERRED EMBODIMENT

In operation, piston valve 50 can be in the open position as shown in FIG. 1, in the seated position or in the closed position.

Valve plunger 72 is displaced into bore 68 when the downward force caused by the pressure of the surrounding liquid acting on the cross-sectional area of valve plunger 72 is greater than the opposing upward bias force of compression spring 70 acting on the other end of the valve plunger. The valve plunger 72 can be pushed down and positioned clear of movement of valve disc 82 by fluid pressure in the rod end chamber acting against its cross-sectional area. Valve disc 82 has equal pressure affected areas on both sides and floats. Since the force of disc spring 86 is comparatively small and since any fluid in the spring cavity 74 is at atmospheric pressure because of vent passage 78, valve plunger 72 can be considered to be balanced between the upward bias force of compression spring 70 and the downward force caused by the liquid pressure within the cylinder. The term "predetermined valve seating pressure" is defined as the pressure in cylinder chamber 13 required to displace the valve plunger 72 downward into bore 68. It is apparent that since the bias force of compression spring 70 and the cross-sectional area of valve plunger 72 are determined by the design of the piston valve 50, the valve seating pressure is also determined by the design of the piston valve, i.e., the valve seating pressure is predetermined by the construction of piston valve 50. The term "predetermined load value" is defined as the external force load which must be applied against piston rod 32 so that the resulting liquid pressure within cylinder chamber 13 will equal the predetermined valve seating pressure, thus putting piston valve 50 in the seated position. The predetermined load value equals the force applied by the predetermined valve seating pressure acting on the cross-sectional area of piston rod 32; i.e. in this operational mode, with the piston valve 50 open, the internal cylinder pressure is proportional to the load force applied to the piston rod and the predetermined load value and the predetermined value seating pressure occur at the same time.

When piston valve 50 is in the seated position, a slightly greater liquid pressure in rod end chamber 30, than in back end chamber 28, will produce an upward force on valve disc 82, opposing disc spring 86, which can separate the valve disc from valve seat 54 and permit liquid flow from rod end chamber 30 to back end chamber 28. The upward force equals the liquid pressure within the lower portion of divided cavity 65 acting on the bottom surface area 84 of valve disc 82 which does not overlap valve seat 54. The downward closing force equals the liquid pressure within the upper portion of divided cavity 65 acting on the top surface 83 of valve disc 82 in addition to the light force applied by disc spring 86. Since this portion of surface area 84 is almost the entire surface area 84, which in turn equals the top surface area 83, and since the force applied by disc spring 86 is comparatively small, it follows that the pressure drop resulting from liquid passing through seated piston valve 50 is insignificantly small. Practice has shown this to be true; and, thus, when liquid passes through seated piston valve 50 from rod end chamber 30 to back end chamber 28, it is considered to be essentially with the same insignificant pressure drop as when liquid passes through the piston valve in the open position.

When the situation occurs where the pressure in rod end chamber 30 is dropped to atmospheric pressure, with piston valve 50 already in the seated position, compression spring 70 would push valve plunger 72 against the underside of valve disc 82. However, the valve plunger would not separate the valve disc from valve seat 54 because of the unopposed downward force against valve disc 82 applied by the liquid pressure in back end chamber 28 acting on surface area 83. It is apparent in this situation that since the pressure difference between chambers 28 and 30 is holding valve disc 82 against valve seat 54, no liquid flow is permitted from back end chamber 28 to rod end chamber 30. This situation where the valve is held closed is defined as the closed position of valve 50.

Describing the operation of hydraulic cylinder 10 requires defining the four operational modes in the complete work cycle: (1) low force rapid extension, (2) moderate force rapid extension, (3) high force extension, and (4) free motion mode. The work cycle starts with piston rod 32 in its retracted position. The low force rapid extension mode begins when pressurized liquid is supplied to back end chamber 28 and piston rod 32 extends at a relatively rapid rate against a load force which is less than the predetermined load value. In this mode piston valve 50 is automatically open thus permitting free liquid flow from rod end chamber 30 to back end chamber 28. When the load force against piston rod 32 increases beyond the predetermined load value, piston valve 50 automatically changes to the seated position but continues to allow essentially free flow of liquid from rod end chamber 30 to back end chamber 28. In this mode piston rod 32 continues to extend at the same rate. While it is difficult to visually detect when the moderate force rapid extension mode begins by merely observing the external performance of the cylinder, this is readily apparent from observation of appropriate instrumentation. The high force extension mode begins when an external control valve (generally an unloading valve) permits liquid to exit rod end chamber 30 and return to the supply reservoir. In this mode (defined earlier as the closed position) piston valve 50 automatically blocks liquid flow from back end chamber 28 to rod end chamber 30 while piston rod 32 continues to extend against the load force but at a reduced rate with an appreciably greater available force. This mode ends and the free motion mode begins when back end chamber 28 is connected to the reservoir by external valving, thus permitting piston valve 50 to automatically open. In this mode piston rod 32 can be moved to its starting retracted position by a relatively small externally applied force at a relatively rapid rate, thus completing the work cycle.

It should be noted that hydraulic cylinder 10 cannot go directly from the initial start condition or from the low force rapid extension mode to the high force extension mode without first entering the moderate force rapid extension mode, thus putting piston valve 50 in the seated position. If this is attempted and liquid is permitted to exit rod end chamber 30 before piston valve 50 is in the seated position, the cylinder will enter an inoperative mode. In this inoperative mode the liquid supplied to back end chamber 28 will pass through the open piston valve 50 to rod end chamber 30 and then exit this chamber to the supply reservoir. In this inoperative mode piston rod 32 cannot exert any force against the load. Obviously, this mode is not desired and is to be avoided.

It should also be noted that in describing the operation of cylinder 10 it has been assumed that mechanical friction and fluid friction are equal to zero or are insignificant. In actual practice, with modest liquid flows, these assumptions are realistic and have little effect on the operation of the cylinder.

FIGS. 4, 5, 6, and 7 are schematic illustrations of hydraulic cylinder 10, as shown in FIG. 1, in the four operational modes, extending against a load force which increases in magnitude as it is compressed. Cylinder 10 is included in a hydraulic system which includes the following conventional components: pump 90 supplying pressurized liquid from liquid reservoir 92 which is maintained at atmospheric pressure; three-way two-position directional control valve 94 which connects back end chamber 28, through port 40, to pump or the reservoir; and two-way, two-position directional control valve 96 which blocks liquid flow or connects rod end chamber 30 through port 42 to reservoir 92. In this system directional control valves 94 and 96 are actuated manually or automatically, for example, by a pilot signal or by one external to this system. In FIGS. 4, 5, 6 and 7 the direction of flow occuring during each mode is shown for piston valve 50 and the external control valves.

Figure 4:
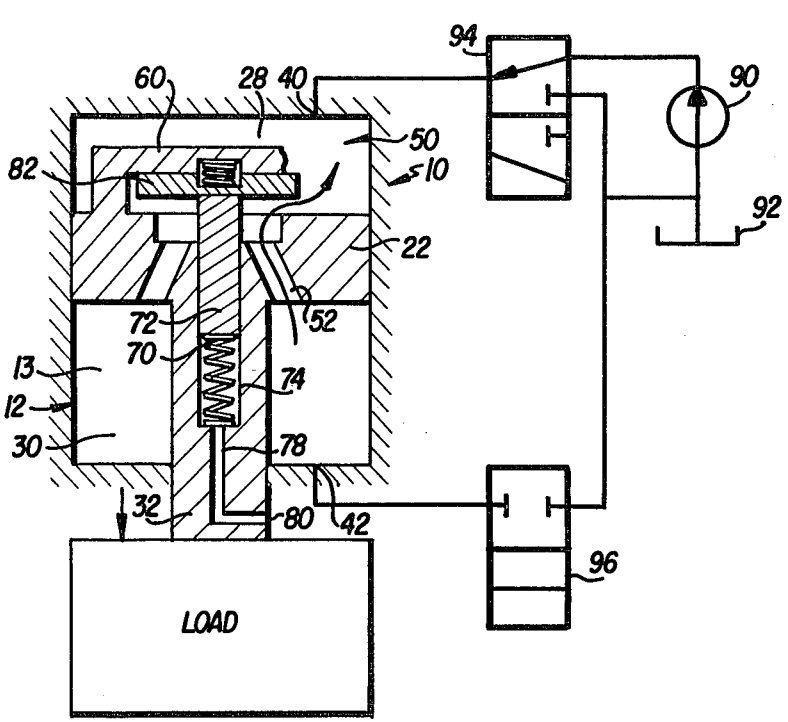
FIG. 4 is a schematic illustration of the hydraulic cylinder piston shown in FIG. 1, together with its associated pressurized liquid supply and control system operating against a load in the low force rapid extension mode.

In FIG. 4 hydraulic cylinder 10 is shown in the low force rapid extension mode with valve 94, its spool in the downward position, conducting pressurized liquid from pump 90 to back end chamber 28 and with valve 96, its spool in the downward position, blocking liquid flow from rod end chamber 30. Piston rod 32 is extending against a relatively light load which is less than the predetermined load value and consequently the liquid pressure in cylinder chamber 13 is below the predetermined valve seating pressure and piston valve 50 is in the open position. The liquid in the contracting rod end chamber 30 is exiting the chamber 30 through flow passage 52 and through piston valve 50 and combining with the liquid supplied by pump 90 to fill the expanding back end chamber 28. Piston rod 32 is extending at a rate where the displacement of the piston rod exiting the cylinder housing 12 equals the displacement of the liquid supplied by pump 90 to back end chamber 28. The force applied against the load by piston rod 32 equals the force resulting from the liquid pressure within cylinder housing 12 acting on the cross-sectional area of piston rod 32.

Figure 5:
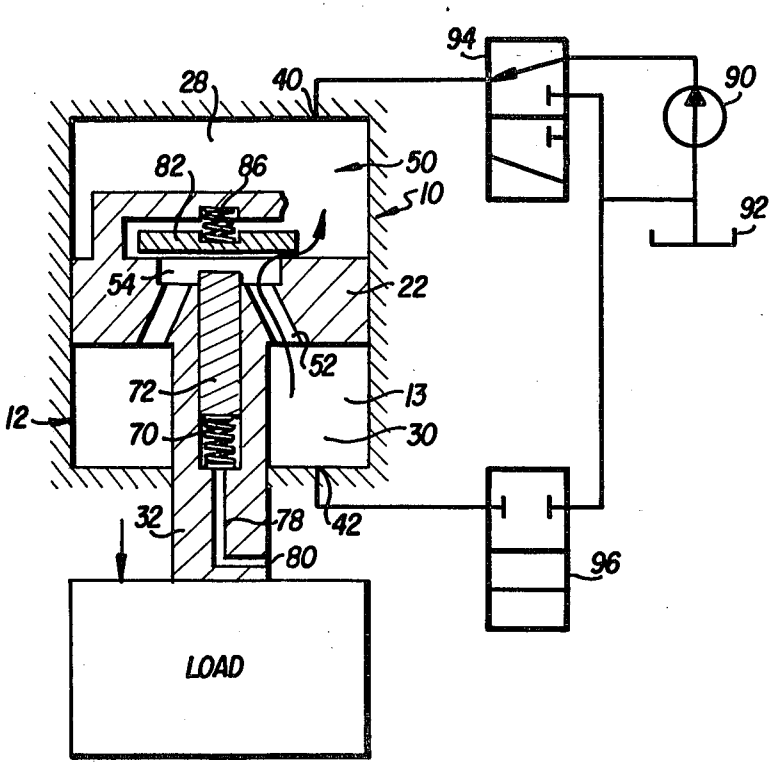
FIG. 5 is a schematic illustration the same as FIG. 4, but showing it operating in the moderate force rapid extension mode.

In FIG. 5 hydraulic cylinder 10 is shown in the moderate force rapid extension mode with piston rod 32 continuing to extend at the same speed against a load which exceeds the predetermined load value. Because of the increased magnitude of the load the liquid pressure within cylinder chambers is greater than the predetermined valve seating pressure and piston valve 50 automatically changes to the seated position. Since piston valve 50 permits essentially free flow from rod end chamber 30 to back end chamber 28 when in the seated position, the description for FIG. 5 is the same as for FIG. 4 except for the higher available load force and the fact that piston valve 50 is in the seated position. There has been no change in control valves 94 and 96.

Both rapid extension modes may be recognizable to one skilled in the art as being similar to the commonly used regenerative cylinder circuit but with the regenerative flow from the rod end chamber 30 to the back end chamber 28 conducted through piston valve 50 located within the piston instead of through exterior valving and flow lines.

A regenerative cylinder circuit is defined as a hydraulic circuit in which discharge fluid is taken from the rod end of a hydraulic cylinder and recirculated directly to the back end, along with pump fluid to augment fluid input. This rod end fluid increases cylinder extension speed in proportion to the volume of fluid regenerated from the rod end. In such a circuit, the pump need only supply the differential volume or the volume previously occupied by the piston rod exiting the cylinder. The maximum force which can be exerted would be equal to the pump supply fluid pressure acting upon the cross-sectional area of the piston rod. When both sides of a cylinder are pressurized simultaneously, as must occur in a regenerative circuit, equal fluid pressure acting on differential piston areas results in a net force which extends the cylinder. Such a circuit is therefore also termed a differential circuit. This circuit causes a cylinder to extend faster than it would if supplied only with pump fluid, but it does so with reduced available force. For example, if the area of the piston is six times the cross-sectional area of the piston rod, the cylinder will advance at six times its normal speed, but with one sixth of its maximum force.

Figure 6:
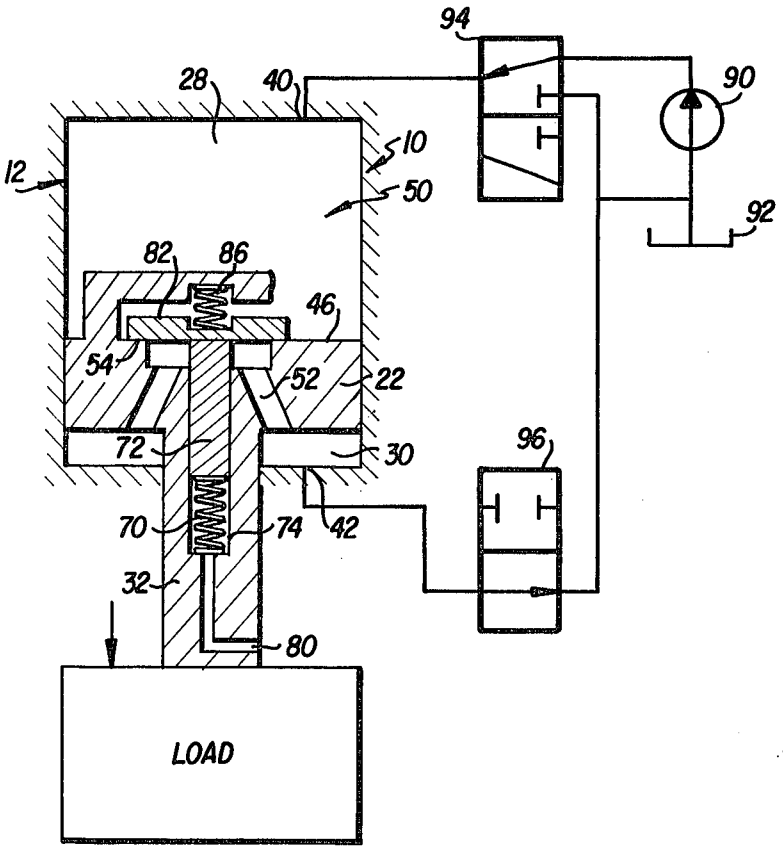
FIG. 6 is a schematic illustration the same as FIG. 4, but showing it operating in the high force extension mode.

FIG. 6 shows hydraulic cylinder 10 continuing to extend piston rod 32 against a greater load, but at a reduced rate, in the high force extension mode. Valve 94 remains with its spool in the downward position conducting pressurized liquid from pump 90 to back end chamber 28. The spool of valve 96 is shifted to the upward position, thus connecting rod end chamber 30 to reservoir 92 and permitting liquid to exit the rod end chamber thereby unloading the pressurized fluid in the rod chamber by dropping the pressure therein to atmospheric pressure and thus maintaining the chamber essentially at atmospheric pressure. Piston valve 50 is changed from seated position in the moderate force rapid extension mode to the closed position in the high force extension mode in automatic response to valve 96 permitting liquid to exit rod end chamber to reservoir 92 at atmospheric pressure. Valve disc 82 is held sealingly against valve seat 54 blocking flow from back end chamber to rod end chamber since it is held there by the difference in liquid pressures between chambers 28 and 30 acting on surface areas 83 and 84 of the valve disc. The bias force of compression spring 70 is applied in the upward direction against valve disc 82 through valve plunger 72, but this is insufficient to overcome the downward pressure related force. In this high force extension mode, hydraulic cylinder 10 is performing in the same manner as a conventional hydraulic cylinder with a solid piston which sealingly divides the opposing chambers. Piston rod 32 extends at a rate where the volumetric expansion of back end chamber 28 equals the displacement of the liquid supplied to the chamber by pump 90. The force applied to the load by piston rod 32 equals the force resulting from the liquid pressure in back end chamber 28 acting on surface 46 which is the cross-sectional area of piston 22.

Figure 7:
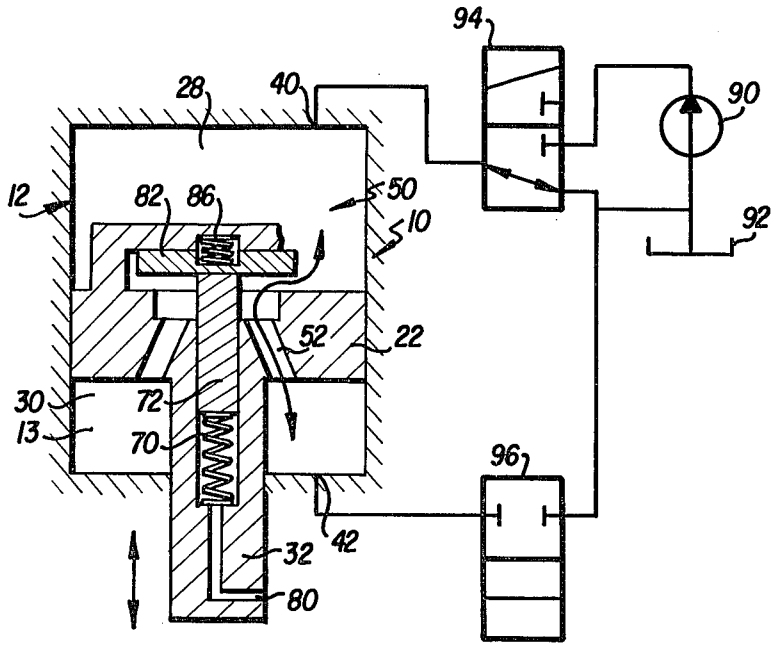
FIG. 7 is a schematic illustration the same as FIG. 4, but not acting against a load but being acted on by an external force, in the free motion mode.

FIG. 7 shows hydraulic cylinder 10 in the free motion mode where the cylinder is unable to exert a force in either direction. The spool of valve 94 is shifted to the upward position thus connecting back end chamber 28 to atmospheric reservoir 92. The spool of valve 96 is shown shifted to the downward position blocking flow from rod end chamber 30; however, the spool of valve 96 could be in either position and not affect the free motion mode. Piston valve 50 is automatically positioned in the open position because the bias opening force of compression spring 70 is unopposed by any pressure related force from within the cylinder chamber 13. A relatively light external force applied to piston rod 32 can move piston 22 in either direction with the liquid in cylinder chamber 13 passing through piston valve 50 from the contracting to the expanding chamber, chambers 28 and 30. During this time liquid will pass through valve 94 to or from back end chamber 28 while equaling the displacement of piston rod 32 exiting or entering cylinder housing 12. Providing an external force to piston rod 32 would return hydraulic cylinder 10 to its initial retracted position thus completing the work cycle.

Figure 8:
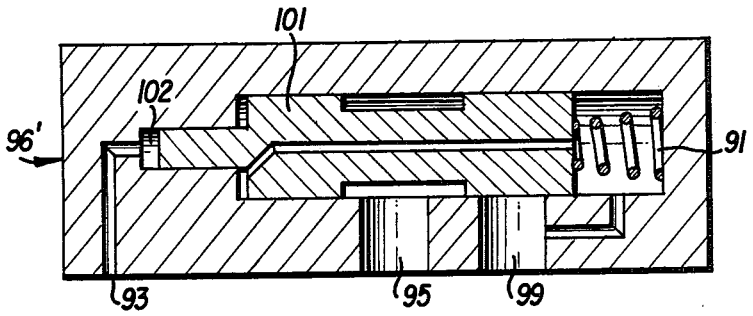
FIG. 8 is a sectional view of a control valve modifying the control system of FIG. 4.

FIG. 8 shows a cross-sectional view of valve 96' which can take the place of valve 96 as shown in FIG. 4. While both valves are basically two-way, two-position directional control, valve 96' has the additional feature in that it is controlled by a pilot signal obtained from back end chamber 28 (or port 40). Valve 96' accomplishes the automatic shifting to the open position, unloading the rod end chamber 30, and initiating the high force extension mode without requiring a signal originated from outside of the described system. Valve 96' is a normally closed pressure responsive valve which shifts to the open position when a pressure is detected in the back end chamber 28 which exceeds a preset magnitude. A conventional commercially available "unloading valve" can be used in this application by connecting the usual "pump port" to the connection from rod end chamber 30. This unloading valve goes from the closed to the open position permitting rod end chamber 30 to be unloaded to atmospheric pressure, whereas a pressure relief valve would also permit flow to exit rod end chamber 30 but would maintain a back pressure as determined by the characteristics of the particular relief valve. Someone skilled in the art would recognize that this back pressure would reduce the maximum available force in the high force extension mode. Valve 96' is shown with valve spool 101 in the closed position held there by spring 91. Ports 93, 96, and 99 are connected by suitable conduits to back end chamber 28, rod end chamber 30, and reservoir 92 respectively. It is apparent that a fluid pressure of sufficient magnitude supplied to cavity 102 would displace the spool, compressing spring 91, thus providing fluid connection between ports 95 and 99, thus connecting rod end chamber 30 to reservoir 92 at atmospheric pressure thereby unloading the pressurizing fluid in the rod end chamber by dropping the pressure therein to atmospheric pressure. Since valve 96' will open when a preset pressure occurs in back end chamber 28, and since that pressure is proportional to the force applied to the load during the moderate force rapid extension mode, valve 96' will automatically initiate the high force extension mode when a load force of a preset magnitude is encountered. No signal need be received from outside of the described system to accomplish this.

Another alternative to valve 96 could be any commercially available valve or combination of valves which perform the previously described two basic functions; (1) first, restrict flow of the liquid exiting rod end chamber 30 to the extent that at least the predetermined valve seating pressure is obtained in cylinder chamber 13, (2) then, permit liquid flow to exit the rod end chamber 30 thus allowing the high force rapid extension mode. Someone skilled in the art would recognize that a flow control valve or a pressure relief valve, as well as a directional control valve as shown in FIG. 4, could fulfill these two functions.

DETAILED DESCRIPTION OF OTHER PREFERRED EMBODIMENTS

Figure 9:
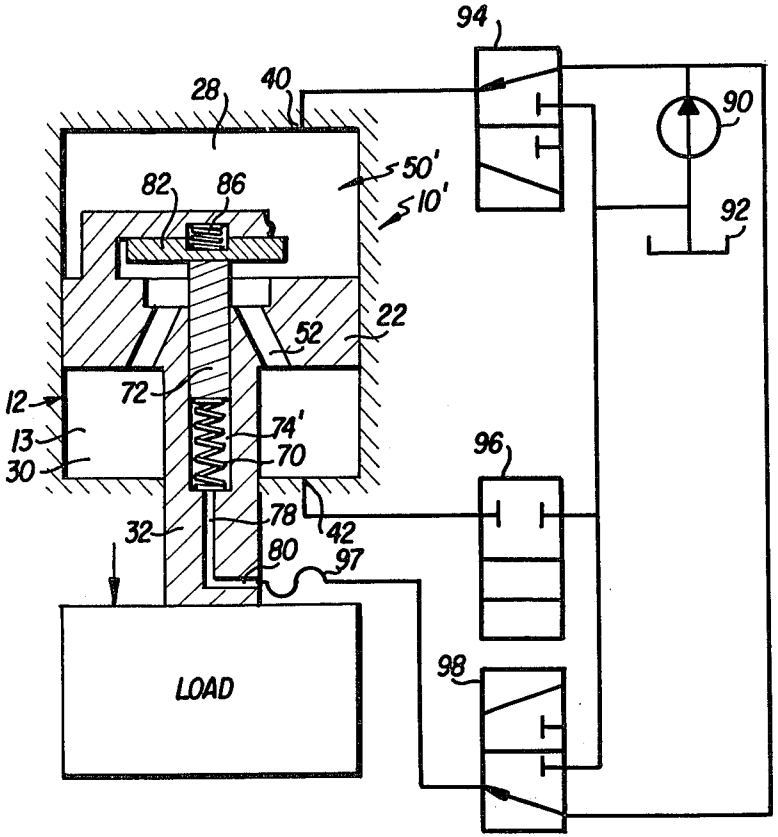
FIG. 9 is a schematic illustration the same as FIG. 4, but modified with the addition of a control valve, which permits a control feature for overruling the high force mode.

FIG. 9 illustrates a modified form of hydraulic cylinder system, the cylinder being generally referred to by reference numeral 10' including piston valve 50' with which a similar fluid supply system is associated including pump 90, reservoir 92 and valves 94 and 96, as hereinbefore described with respect to FIGS. 4, 5, 6 and 7. The hydraulic cylinder 10' is also similar to the cylinder 10, hereinbefore previously described, but with the addition of overruling valve 98 and flexible conduit 97 which connects the overruling valve to newly numbered port 80' on the surface of piston rod 32. Overruling valve 98 is a conventional two-way two-position directional control valve, which is actuated manually or automatically by an external control signal, which selectively connects port 80' to either the atmospheric pressure reservoir 92 or to the pressurized liquid supplied by pump 90. FIG. 9 shows overruling valve 98 with its spool in the upper position connecting spring cavity 74' to liquid pressure by means of passage 78, port 80', flexible conduit 97, valve 98 and connecting pipes to pump 90. With overruling valve 98 in this position, the pressure of the fluid in spring cavity 74' would be the same as the supply pressure of pump 90. This fluid pressure in spring cavity 74' would act on the cross-sectional area of valve plunger 72 and produce an upward force which would combine with the bias force of compression spring 70 to lock piston valve 50' in its open position regardless of the position of control valves 94 or 96, or the magnitude of the load applied against piston rod 32. Piston valve 50' cannot be seated when locked in the open position because the maximum valve closing force equals the liquid pressure of pump 90 acting on the cross-sectional area of valve plunger 72 and the force supplied by light disc spring 86. This overruling control circuit has proven useful in practice for locking a cylinder out of the high force extension mode for safety purposes, and for situations when it is desirable to open piston valve 50' especially fast at the conclusion of the high force mode. When overruling valve 98 is in its alternate position with its spool in the lower position thus connecting spring cavity 74' to atmospheric pressure by means of passage 78, port 80', flexible conduit 97, valve 98 and connecting pipes to reservoir 92, hydraulic cylinder 10' would perform the same in all operational modes as shown in FIGS. 4, 5, 6, and 7.

Figure 10:
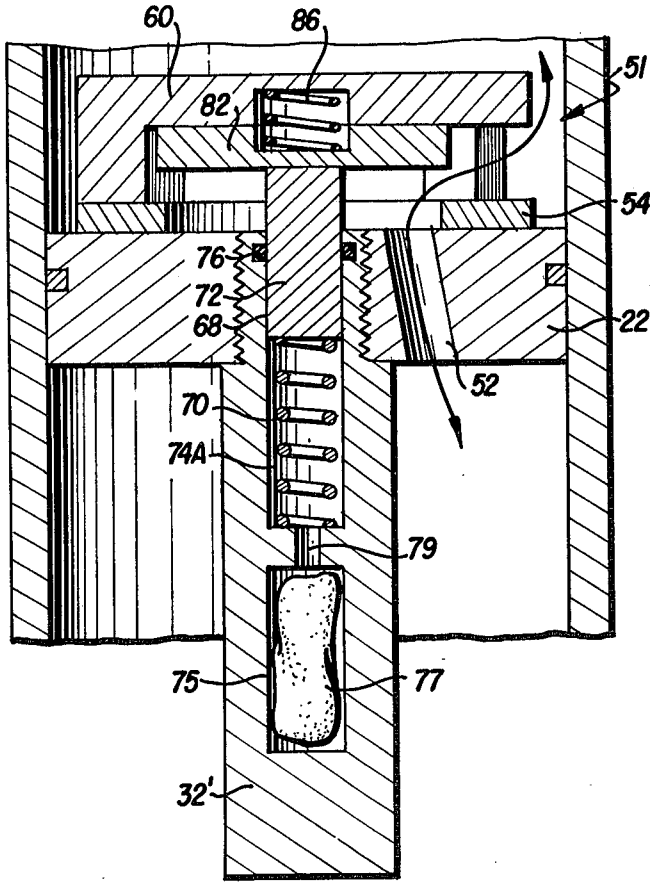
FIG. 10 is a partial section view showing a modification of the piston valve of FIG. 1 which eliminates the vent passage extending down to piston rod.

FIG. 10 illustrates a modified embodiment of the invention which eliminates the vent passage 78 and vent port 80 in piston rod 32 as shown in FIG. 1. FIG. 10 shows piston valve 51 with piston 22 connected to piston rod 32' which is modified to form chamber 75 therein containing a compressible cellular material, such as a flexible gas filled container 77 having at least one closed cell, the enclosed gas being preferably at atmospheric pressure. A multicellular material having a plurality of closed cells such as a flexible closed cell plastic foam may be used. Chamber 75 is in fluid communication through passage 79 with spring cavity 74A within which compression spring 70 is contained. Compression spring 70 exerts a continual bias force in the upward direction on slidable valve plunger 72. The compressible material filled with gas at atmospheric pressure permits operation of piston valve 51 by compressing to a reduced volume when valve plunger 72 is forced into bore 68 with the seating of piston valve 51. This flexible gas filled container 77 eliminates filling of chamber 75 with noncompressible fluid which would impair operation of valve assembly 51. The closed cell gas filled container 77 associated with the modification of FIG. 10 performs the same function, namely to provide a reference pressure, as hereinbefore described with respect to FIGS. 4, 5, 6 and 7 wherein spring chamber is vented to the atmosphere by means of vent passage 78 and vent port 80 to provide an equivalent reference pressure. In practice piston valve 51 has demonstrated the same performance characteristics as piston valve 50.

Figure 11:
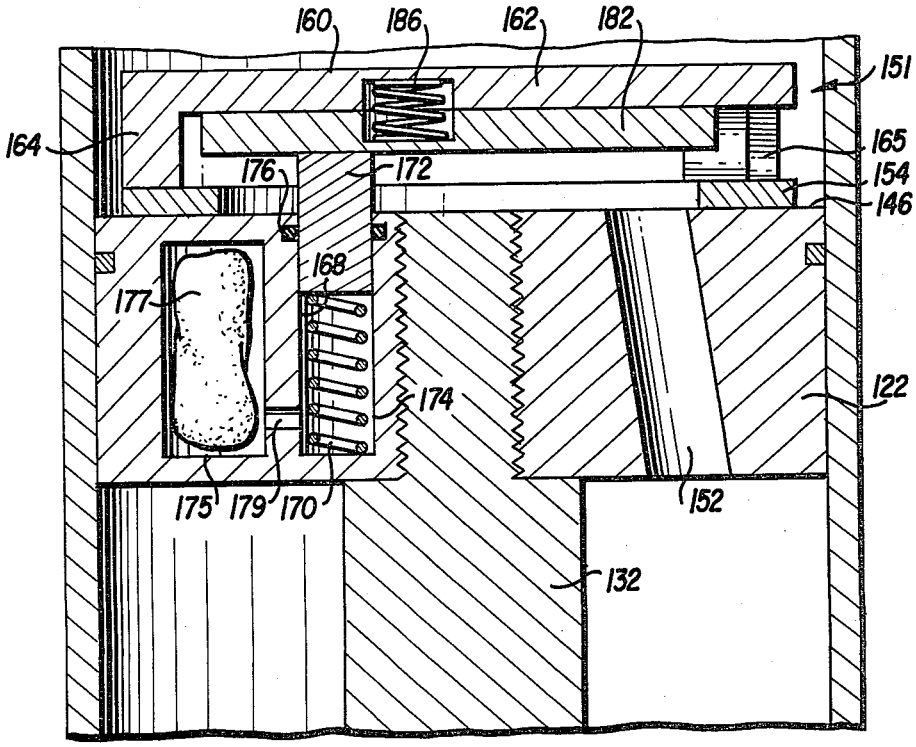
FIG. 11 is a partial section view of the piston valve of FIG. 10 showing an alternate construction which requires no modification to the piston rod, but only to the piston.

FIG. 11 shows piston valve 151 as an alternate construction to piston valve 51 as shown in FIG. 10. Piston valve 151 requires bores and passages in piston 122 but does not require any modification to piston rod 132. Piston valve 151 and piston valve 51 perform similar functions in the four operational modes as described in FIGS. 4, 5, 6 and 7. Piston valve 151 differs from piston valve 51 only with regard to a location and geometric standpoint, the parts making up both piston valves having equivalent counterparts which perform the same functions. It is apparent that piston valve 151 is not symmetric as in the case of piston valve 51 in FIG. 10 and piston valve 50 as shown in FIG. 1. In piston valve 151, bore 168, containing seal 176 and receiving bias compression spring 170 and valve plunger 172 to form spring cavity 174, is located off the center line in piston 122. Passage 179 connects spring cavity 174 to chamber 175 which contains compressible material 177. Chamber 175 and passage 179 are located wholly in piston 122 as well as flow passages 152. Valve seat 154 and retainer cap 160, which is made up of stop disc portion 162 and spacer legs 164, are sealingly mounted on surface 146 of piston 122. Valve disc 182 is loosely contained under retainer cap 160 within chamber 165 formed generally under the cap. The bias force of compression spring 170 acts on valve plunger 172 which, in turn, holds valve disc 182 away from valve seat 154 when the internal cylinder liquid pressure is below the predetermined valve seating pressure. Above this pressure, plunger 172 is displaced into bore 168 and light disc spring 186 pushes valve disc 182 toward valve seat 154. It is apparent that symmetry or central location of bore 168, valve disc 182, or disc spring 186 is not required as long as piston valve 151 can exist in the open position, the seated position, and the closed position, dividing chamber 165 in the latter two positions.

Figure 11A:
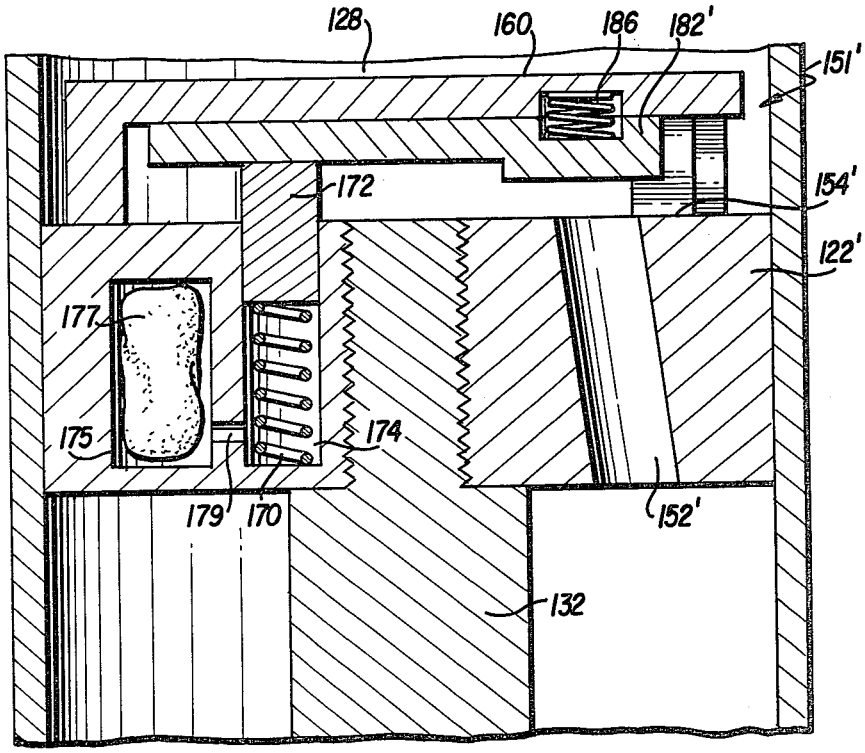
FIG. 11A is a partial section view of the piston valve in FIG. 11 showing an alternate construction.

FIG. 11A shows piston valve 151' an alternate construction to piston valve 151 as shown in FIG. 11, with all machining operations being performed in the piston 122' and none in the piston rod 132. This construction of piston valve 151' is not necessarily symmetric or located on the center line of the geometric axis. The description of FIG. 11 applies to FIG. 11A with the exception that the valve seat 154' is a part of the piston 122' and the seating surface of valve disc 182' is raised on a boss. With this arrangement the seating surface is much smaller, extending only around passage 152', not including plunger 172'. This construction reduces the area of valve disc 182' which is affected by the pressure differential between opposing chambers 128 and 130 during the high force mode. This is an important consideration regarding the material strength of the valve disc for high fluid pressure applications.

Figure 12:
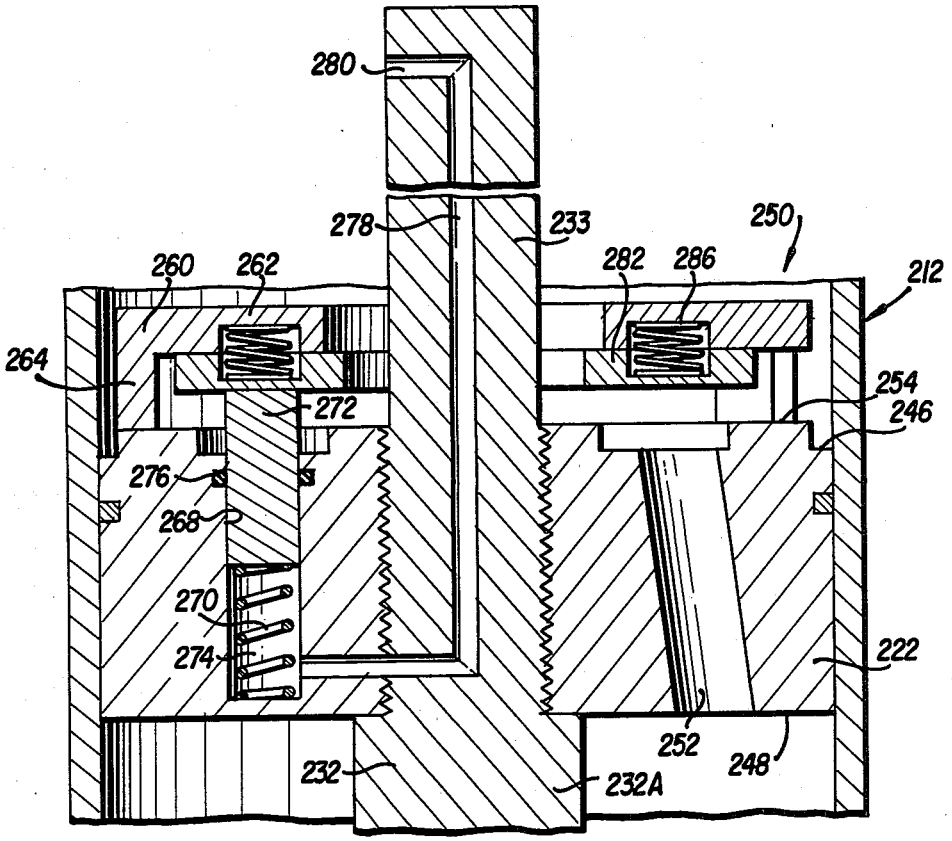
FIG. 12 is a partial section view showing a modification of piston valve 50 of FIG. 1, adapted to a hydraulic cylinder piston device which has a piston rod extending from both ends of the cylinder.

FIG. 12 shows piston valve 250 as an alternate construction to piston valve 50 shown in FIG. 1 which adapts the piston valve to a hydraulic cylinder with a double-ended piston rod extending from both faces of the piston and exiting from both ends of the cylinder housing. FIG. 12 shows piston 222 fastened to the piston rod, the lower portion 232A of piston rod 232 which extends from face 248 has a larger cross-sectional area than the upper portion 233 which extends from face 246. Both piston rod extensions exit the cylinder housing at the ends through sealed bearings. Piston valve 250 and piston valve 50 perform the same in the 4 operational modes as described in FIGS. 4, 5, 6 and 7. Piston valve 250 differs from piston valve 50 with regards to construction, mainly from a location and geometric standpoint; but the elements comprising both piston valves have equivalent counterparts which perform the same functions. Piston valve 250 includes single or multiple spring loaded valve plunger assemblies which include bore 268, seal 276, compression spring 270, valve plunger 272, spring cavity 274, and passage 278. Passage 278 connects spring cavity 274 to port 280 by passing through piston 222, piston rod portion 232, and piston rod portion 233. Vent port 280 exits to atmosphere at a location on piston rod 233 which is always external to cylinder housing 212. A plurality of flow passages 252 pass through piston 222. Retainer cap 260 is made up of an annular shaped stop disc portion 262 and spacer legs 264. Valve seat 254 consists of two annular shaped sections which are formed in piston 222 and do not consist of a separate part. Valve disc 282, loosely contained within retainer cap 260, has an annular shape which will sealingly match valve seat 254 when in the seated position. Multiple light disc springs 286 serve to seat valve disc 282 against valve seat 254 when valve plunger 272 is displaced into bore 268 away from the valve disc.

The operational modes of the construction of FIG. 12 are obvious when compared to the description of the other embodiments. It should be noted that the hydraulic cylinder in FIG. 12, when operating in either rapid extension mode, will extend its larger piston rod at a rate in which the displacement of the liquid supplied by the pump equals the displacement of the larger piston rod exiting the cylinder housing less the displacement of the smaller piston rod entering the housing. The load force in both rapid extension modes equals the internal liquid pressure acting on the difference in cross-sectional areas of the two piston rods.

It is apparent that the piston valve in FIG. 12 could replace the vent passage down the piston rod with the chamber containing the compressible material as shown in FIGS. 10, 11, and 11A. It is also apparent that the construction of the piston valve in FIG. 1 or FIG. 12 need not be symmetrical or concentric.

While there have been illustrated and described herein what at present are considered to be the preferred embodiments of the instant invention, it will be readily appreciated by those skilled in the art that various changes and modifications may be made in the practice of the instant invention without departing from its spirit or scope or departing from the clear teachings of the invention. Therefore, it is intended that the scope of the invention be limited only by the appended claims and not by the embodiments described.

The invention claimed is:

1. In combination with a liquid fluid piston device having a pressure sealed housing, a slidable piston therein having two opposed faces of differential areas and dividing said cylinder housing into two opposing pressure chambers of variable volume, a piston rod extending from said piston passing through one of said chambers and extending from said housing, said chamber being the rod end chamber, a source of pressurized fluid, conduit means for permitting flow of pressurized fluid into and out of each of said pressure chambers, first valve means for selectively conducting fluid to the other of said opposing chambers to effect displacement of said piston, said other chamber being the back end chamber; automatic means for varying the extension force modes of said device in response to changes in pressure conditions within said chambers, comprising first passage means in said piston for conducting free flow of fluid through said piston between said opposing chambers, second valve means having a stationary valve seat and independently movable discrete unattached elements actuated by changes in fluid pressures within said chambers in response to increased loads and movable in response to changes in pressures through a plurality of positions thereby providing sequentially low force rapid extension mode of movement, moderate force rapid extension mode of movement, and high force relatively slow extension mode of movement, second passage means fluidly connecting a reference pressure to said second valve means independent of pressures within said chambers, bias spring means for holding said second valve means in an open position until overcome by the fluid pressure in a chamber when the resisting load exceeds a predetermined value thereby allowing said second valve means to restrict flow between said chambers to uni-directional flow from the rod end chamber to the back end chamber and thereafter blocking flow between said chambers when pressure is unloaded from the rod end chamber, relatively lighter means continually urging said valve means to a seated position, and third valve means connected to said rod end chamber for unloading pressurized fluid from said chamber to provide said high force mode.

2. The combination of claim 1 wherein said second valve means is controlled solely by fluid pressures through sequence of said movements.

3. The combination of claim 2 wherein said plurality of valve positions comprises in sequence an open, a seated, and a closed position.

4. The combination of claim 3 wherein said second passage means is channeled within said piston rod.

5. The combination of claim 3 wherein said conduit means for providing flow of fluid into and out of said back end chamber is connected to a fluid reservoir at atmospheric pressure, thereby automatically opening said piston valve and permitting bi-directional flow between said chambers and providing an additional free motion mode allowing a rapid return of the piston rod to its initial retracted position.

6. The combination of claim 3 wherein said relatively lighter means is a second spring means.

7. The combination of claim 6 wherein said second valve means includes (a) an independent freely movable valve disc having opposing pressure faces, one of said pressure faces being adapted to seat on a cooperating valve seat, (b) said stationary valve seat for said disc mounted on the back end of said piston for seating engagement by one of the faces of said valve disc, (c) retainer means connected to said piston limiting movement of said valve disc between said positions and aligning said disc with said seat, (d) independently movable piston plunger means engaging with said bias spring means and extensible towards said valve disc to engage with said seating face of said disc to urge it towards an open position, (e) guide means mounted in said piston rod for slidably carrying said plunger, and (f) second spring means relatively lighter than said bias spring means positioned between said retaining means and the face of said valve disc opposite from said seating face urging said disc towards the seated position.

8. The combination of claim 7 wherein said guide means includes a cavity formed in said piston rod within which said plunger is sealingly received, said bias spring means being enclosed in said cavity, and said second passage means being connected to said cavity.

9. The combination of claim 8 wherein said second passage means includes a vent extending through said piston rod connected with a reference pressure.

10. The combination of claim 9 wherein said reference pressure is an atmospheric reference pressure.

11. The combination of claim 9 including an overruling system locking said second valve in the open position comprising selective valve means connected between said vent passage means and said reference pressure selectively connecting said vent passage means to said reference pressure and to said source of pressurized fluid.

12. The combination of claim 8 wherein said second passage means terminates in a closed chamber within said piston rod housing a flexible container enclosing at least one closed cell filled with a compressible gas.

13. The combination of claim 12 wherein said flexible container encloses a plurality of closed cells.

14. The combination of claim 3 wherein elements of said automatic means are asymmetrical and mounted on and within said piston offset from the geometrical axis of said piston.

15. The combination of claim 14 wherein said piston rod extends from both opposed faces of said piston downwards through said rod end chamber and upwards through said back end chamber, the cross-section of that portion of said piston rod extending through said rod end chamber having a greater cross-sectional area than that portion of the piston rod extending through the back end chamber.

16. The combination of claim 3 wherein said third valve is automatically controlled by a pilot pressure signal from the conduit supplying fluid to the back end chamber.

17. In combination with a liquid fluid piston device having a pressure sealed housing, a slidable piston therein having two opposed faces of differential areas and dividing said cylinder housing into two opposing pressure chambers of variable volume, a piston rod extending from said piston passing through one of said chambers and extending from said housing, said chamber being the rod end chamber, a source of pressurized fluid, conduit means for permitting flow of pressurized fluid into and out of each of said pressure chambers, first valve means for selectively conducting fluid to the other of said opposing chambers to effect displacement of said piston, said other chamber being the back end chamber; automatic means for varying the extension force modes of said device in response to changes in pressure conditions within said chambers, comprising first passage means in said piston for conducting free flow of fluid through said piston between said opposing chambers, second valve means in said back end chamber having a stationary valve seat and independently movable discrete unattached elements actuated by changes in fluid pressures within said back end chamber in response to increased loads and movable in response to changes in pressure through a plurality of positions thereby providing sequentially low force rapid extension mode of movement, moderate force rapid extension mode of movement, and high force relatively slow extension mode of movement, second passage means fluidly connecting a reference pressure to said second valve means independent of pressures within said chambers, bias spring means for holding said second valve means in an open position until overcome by the fluid pressure in a chamber when the resisting load exceeds a predetermined value thereby allowing said second valve means to restrict flow between said chambers to uni-directional flow from the rod end chamber to the back end chamber and thereafter blocking flow between said chambers when pressure is unloaded from the rod end chamber, relatively lighter means continually urging said valve means to a seated position.

18. The combination of claim 17 wherein said second valve means includes (a) an independent freely movable valve disc having opposing pressure faces, one of said pressure faces being adapted to seat in a cooperating valve seat, (b) said stationary valve seat for said disc mounted on the said piston for seating engagement by one of the faces of said valve disc, (c) retainer means connected to said piston limiting movement of said valve disc between said positions and aligning said disc with said seat, (d) independently movable piston plunger means engaging with said bias spring means and extensible towards said valve disc engaging with said seating face of said disc to urge it towards an open position, (e) guide means mounted in said piston rod for slidably carrying said plunger, and (f) second spring means relatively lighter than said bias spring means positioned between said retaining means and the face of said valve disc opposite from said seating face urging said disc towards the seating position.

* * * * *